United States Patent [19]

Mack

[11] Patent Number: 4,787,099

[45] Date of Patent: Nov. 29, 1988

[54] DISPOSABLE LIMITED REUSABLE BIB

[75] Inventor: Robert J. Mack, Aberdeen, N.J.

[73] Assignee: Colgate-Palmolive Company, New York, N.Y.

[21] Appl. No.: 113,107

[22] Filed: Oct. 26, 1987

[51] Int. Cl.[4] ..... A41B 13/10

[52] U.S. Cl. ..... 2/49 R

[58] Field of Search ..... 2/49 R, 48, 46, 50, 2/51, 49 A

[56] References Cited

U.S. PATENT DOCUMENTS

| | | | |
|---|---|---|---|
| 2,835,895 | 5/1958 | Wells | 2/49 R |
| 3,857,116 | 12/1974 | Meeker | 2/49 R X |
| 4,174,542 | 11/1979 | Vistins | 2/48 |
| 4,646,365 | 3/1987 | Suprise et al. | 2/49 R |

FOREIGN PATENT DOCUMENTS

| | | | |
|---|---|---|---|
| 2091083 | 7/1982 | United Kingdom | 2/49 R |

OTHER PUBLICATIONS

Introductory Textile Science by Marjory Joseph, 3rd Ed., 1977, pp. 319–320, "Absorbent Finishes".

Introductory Textile Science, 3rd Ed. by Majory L. Joseph, copyright 1977, pp. 280, 281, 439.

*Primary Examiner*—Werner H. Schroeder

*Assistant Examiner*—Jeanette E. Chapman

*Attorney, Agent, or Firm*—M. M. Grill; N. Blumenkopf

[57] ABSTRACT

A disposable limited reusable bib comprising a sheet of non-woven hydrophobic material having a weight of from 20 grams to 100 grams per square yard and having a plurality of projecting nubbins for simulating a terry-cloth appearance for facilitating wiping and food catching.

5 Claims, 1 Drawing Sheet

DISPOSABLE LIMITED REUSABLE BIB

BACKGROUND OF THE INVENTION

1. Field of the Invention

This invention relates to disposable items for clothing protection and, more particularly, to a disposable, yet limitedly reusable, bib, which renders the use thereof more economical than other existing disposable items of similar nature.

2. Description of the Prior Art

There are many United States patents which describe disposable bib construction. These include U.S. Pat. Nos. 4,330,888, 4,416,025, 4,423,523, 4,475,250, 4,441,212, 4,445,231, 4,495,658, 4,523,333 and 4,523,334. Each of these patents specify that the disposable bib be produced using very inexpensive plastic sheets, paper tissue or laminates of plastic and paper tissue. Becuase of this material selection, these products can only practically be used one time, thus decreasing the possibility of several meal usages due to the expense involved.

Prior disposable bibs constructed of hydrophobic material were so smooth on their surfaces that they could not effectively be used for wiping purposes as, for example, the wiping of food about an infant's or young child's mouth.

Further, when the bibs were made of absorbent paper or like materials, sizable fluid spills would often penetrate to the garments being protected.

OBJECTS OF THE INVENTION

It is the primary object of the present invention to provide a disposable bib capable of being manufactured at a cost very little more than the existing bibs which are made of the cheapest of materials—yet, which is strong enough and made of such materials as to permit from three to six, or even more washings and uses.

It is a further object of the invention to provide a disposable limited reusable bib which facilitates the retention of fallen food particles, yet which also facilitates wiping functions.

SUMMARY OF THE INVENTION

The present invention contemplates a bib formed of a non-woven sheet material having a weight of from about 20 to 100 grams per square yard. This material is preferably spunbonded, but can be heat bonded or chemically or adhesively bonded and is formed of fibers selected from such hydrophobic materials as polyethylene, polypropylene, nylon or polyesters. The non-woven sheet materialis preferably provided with outwardly projecting nubbins for simulatation of terrycloth-like material. This non-woven sheet material enhances the catching of food particles and wiping of the mouths of infants, young children, the infirm, ages or disabled.

DETAILED DESCRIPTION OF THE INVENTION

Figure 1:
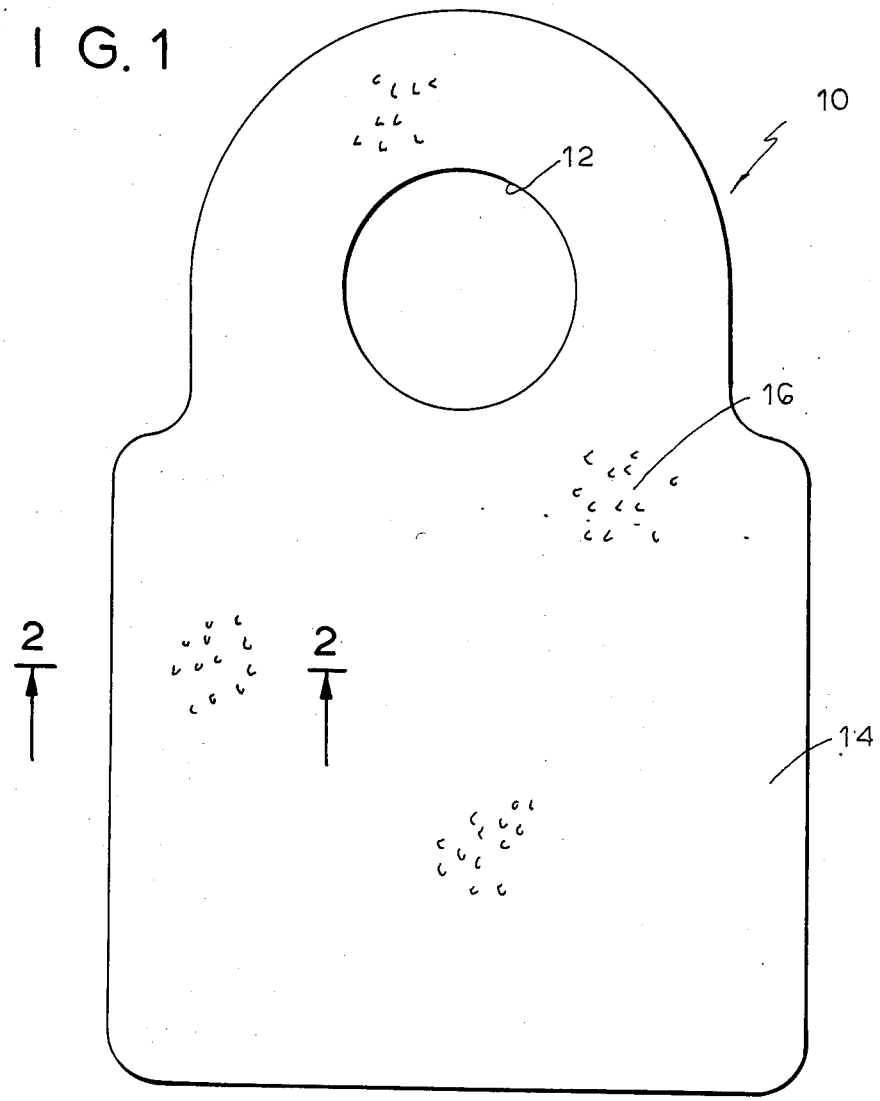
FIG. 1 is a plan view of a bib according to the present invention.
Figure 2:
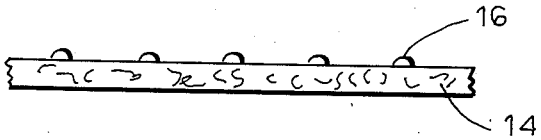
FIG. 2 is a sectional detail view, taken along the plane of line 2—2 in FIG. 1.

With continuing reference to the accompanying drawing, wherein like reference numerals designate similar parts throughout the various views, the bib according to the present invention is generally indicated at 10. The bib 10 may be of such size as to be used by infants, young children and in larger sizes for use by the infirm or aged, or may be provided for diners for use when eating foods likely to cause stains. Further, the bib may be made in such shapes, including pockets, with strings or strips and any other accoutrements known in the art and considered desirable.

The bib 10 is provided with an opening 12 in the sheet 14 from which the bib is fabricated. The material from which the sheet 14 is made is a non-woven material, preferably formed of hydrophobic fibers, such as nylon, polyester, polyethylene or polypropylene. If greater absorbence is desirable or found allowable, a small percentage of rayon fibers can be used.

Unlike most non-woven hydrophobic material products, the sheet 14 is fabricated from a relatively heavyweight material having a weight of from 20 to 100 grams per square yard and, most preferably, about 30 grams per square yard.

The sheet 14 is provided with a plurality of nubbins 16, preferably in the order of 2 to 10 nubbins per running inch and, most preferably from 3 to 4 per running inch, i.e. most preferably from 9 to 16 per square inch simulating terrycloth.

The nubbins 16 have the dual advantage in that they serve to catch and retain morsels of food, drips and crumbs and the hydrophobic properties of the sheet 14 permits its easy rinsing and reuse. The terrycloth appearance provides for a freshness of appearance belying its reuse. The other advantage provided by the nubbins 16 is that, unlike slick-surfaced materials, the nubbins 16 facilitate wiping of the mouth and associated areas of the wearer, permitting a scrubbing-like action to remove caked material.

Figure 3:
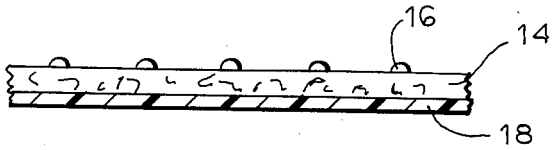
FIG. 3 is a sectional detail view of another embodiment of the present invention; and, FIG. 4 is a sectional detail view of yet another embodiment of this invention.

Referring now to FIG. 3, herein there is shown a form of the invention wherein the sheet 14 is provided with a backing sheet 18. The backing sheet 18 is made from a fluid impervious film material, such as sheet polyethylene or polypropylene, and is heat sealed, or chemically or adhesively bonded to the sheet 12 or may be sonic welded thereto. The sheet 18 provides for absolute protection against penetration through the sheet 12 of any food materials, liquids or the like.

Figure 4:
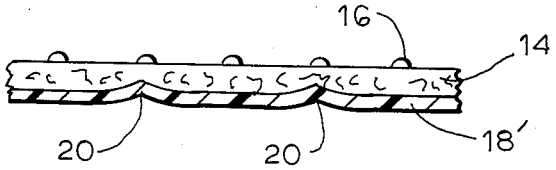

In FIG. 4 there is shown a modification of the invention wherein the sheet 18' is quilted to the sheet 12. The quilting is achieved by spaced lines of heat sealing running both horizontally and vertically or, otherwise, at suitable angles to each other so as to form areas of about one-half square inch to one square inch in area. The quilting proves for slightly rigidifying the nubbins 16 causing them to project more firmly outwardly for better catching and retaining of food particles. Such quilted lines are indicated at 20.

What is claimed is:

1. A disposable limited reusable bib comprising a sheet of hydrophobic non-woven material, means for securing said bib about the torso of a person, said having a weight of between 20 to 100 grams per square yard, said non-woven material being configurated to simulate terrycloth and having a plurality of outwardly projecting nubbins for the simulation of terrycloth for facilitating retention of food dropped thereon and for enhancing wiping qualities of said bib.

2. A disposable limited reusable bib according to claim 1, including a backing sheet secured to said sheet of non-woven material.

3. A disposable limited reusable bib according to claim 1, wherein said non-woven material has a weight of 30 grams per square yard.

4. A disposable limited reusable bib comprising a sheet of hydrophobic non-woven material, means for securing said bib about the torso of a person, said sheet having a weight of between 20 to 100 grams per square yard, said non-woven material simulating terrycloth and having a plurality of projecting nubbins, and a backing sheet of fluid impervious film bonded to said non-woven material along the peripheral edges thereof.

5. A disposable limited reusable bib according to claim 4, wherein said film is heat sealed at spaced intervals throughout its entire area to said sheet of non-woven material to direct said rubbins and hold said nubbins outwardly of said sheet of non-woven material, said non-woven material and said backing sheet forming a quilted configuration.

* * * * *